US009644149B2

(12) United States Patent
Hill

(10) Patent No.: US 9,644,149 B2
(45) Date of Patent: May 9, 2017

(54) MEDIUM PRESSURE STEAM INTERVENTION IN AN OLEFIN CRACKING FURNACE DECOKE PROCEDURE

(71) Applicant: INEOS USA LLC, League City, TX (US)

(72) Inventor: Rex A. Hill, Alvin, TX (US)

(73) Assignee: INEOS USA LLC, League City, TX (US)

( * ) Notice: Subject to any disclaimer, the term of this patent is extended or adjusted under 35 U.S.C. 154(b) by 657 days.

(21) Appl. No.: 14/019,275

(22) Filed: Sep. 5, 2013

(65) Prior Publication Data

US 2014/0060586 A1 Mar. 6, 2014

Related U.S. Application Data

(60) Provisional application No. 61/781,370, filed on Mar. 14, 2013, provisional application No. 61/697,765, filed on Sep. 6, 2012.

(51) Int. Cl.

| | |
|---|---|
| ***C10B 43/02*** | (2006.01) |
| ***C10G 9/16*** | (2006.01) |
| ***B08B 9/032*** | (2006.01) |
| ***B08B 9/027*** | (2006.01) |

(52) U.S. Cl.

CPC ..... *C10B 43/02* (2013.01); *B08B 9/027* (2013.01); *B08B 9/0321* (2013.01); *B08B 9/0323* (2013.01); *C10G 9/16* (2013.01); *B08B 2230/01* (2013.01)

(58) Field of Classification Search

CPC ..... B08B 9/027; B08B 9/032; B08B 9/0321; B08B 9/0323; B08B 9/0327; B08B 2230/01; C10B 43/02; C10G 9/16; F28G 13/005

See application file for complete search history.

(56) References Cited

U.S. PATENT DOCUMENTS

| | | | | |
|---|---|---|---|---|
| 2,289,351 A | | 7/1942 | Dixon et al. | |
| 4,376,694 A | * | 3/1983 | Lohr | C10G 9/16 134/2 |
| 2003/0035766 A1 | | 2/2003 | Baca et al. | |
| 2008/0128330 A1 | | 6/2008 | McCoy et al. | |
| 2010/0174130 A1 | * | 7/2010 | Spicer | C10G 9/16 585/648 |

FOREIGN PATENT DOCUMENTS

| | | | |
|---|---|---|---|
| EP | 1348753 | A1 | 10/2003 |
| WO | WO-98/56872 | A1 | 12/1998 |
| WO | WO-2008/137932 | A1 | 11/2008 |
| WO | WO-2014/039694 | A1 | 3/2014 |

OTHER PUBLICATIONS

International Search Report, PCT/US2013/058285, 4 pages, Dec. 13, 2013.

Written Opinion, PCT/US2013/058285, 6 pages, Dec. 13, 2013.

* cited by examiner

*Primary Examiner* — Michael Kornakov
*Assistant Examiner* — Natasha Campbell
(74) *Attorney, Agent, or Firm* — Choate, Hall & Stewart LLP; William R. Haulbrook; Alexandra D. Augst

(57) ABSTRACT

Described herein is a method for removing coke deposits in radiant tubes of an olefin cracking furnace and removing accumulated spalled coke from one or more outlet elbows of the olefin cracking furnace without performing a cold shutdown of the furnace.

62 Claims, 4 Drawing Sheets

MEDIUM PRESSURE STEAM INTERVENTION IN AN OLEFIN CRACKING FURNACE DECOKE PROCEDURE

CROSS REFERENCE TO RELATED APPLICATIONS

The present application claims priority to U.S. provisional application Ser. No. 61/697,765 filed Sep. 6, 2012, and U.S. provisional application Ser. No. 61/781,370 filed Mar. 14, 2013, the entire contents of which are incorporated herein by reference.

TECHNICAL FIELD

The present invention relates generally to the use of medium pressure steam to address plugged outlets. More particularly, in certain embodiments, the invention relates to methods and systems for removing coke deposits in primary transfer line exchanger (PTLE) outlets. In certain embodiments, the methods and systems are used as an adjunct, or backup, step in an traditional steam-air decoking procedure conducted on an olefin cracking furnace.

BACKGROUND

Olefins are a class of hydrocarbons with a single double bond and a chemical formula of $C_nH_{2n}$. Ethylene and propylene are important industrially-produced olefins, because they feature a highly reactive double bond and provide an ideal molecule for conversion to many useful products. For example, olefins are used for the production of polymers such as polyethylene and polypropylene. Other olefin-based petrochemical products include ethylene dichloride, ethylene oxide, propylene oxide, oxo alcohol, polystyrene, and acrylonitrile.

Most of the world's ethylene and propylene is produced from thermal cracking of hydrocarbon feedstocks ranging from ethane to vacuum gas oils. There are a number of proprietary technologies for the production of olefins in a cracking furnace including, for example, Selective Cracking Optimum Recovery (SCORE™). This technology employs a pyrolysis furnace designed for reaction of the feed stream with high olefin yield and a low-pressure distillation tower designed for efficient product recovery. A typical cracking furnace is a large complex machine that produces a large quantity of olefin product, for example, 100,000 metric tons per annum (100 kTA), 220,000 metric tons per annum (220 kTA), or more.

In a cracking furnace, gaseous or liquid hydrocarbon feed such as naphtha or ethane is quickly heated in the absence of oxygen. Reaction occurs at a very high temperature, for example, from 1450° F. to 1700° F., for a very short period of time. Residence time may be on the order of milliseconds and is kept low by the use of high gas velocities, thereby improving product yield.

Normal operation of olefin cracking furnaces results in a gradual build-up of coke within the furnace tubes. Decoking is the process of periodically removing built-up coke from the interior of the furnace tubes in order to maintain heat exchange efficiency and proper operation of the furnace.

An example decoking process is steam-air decoking Steam-air decoking may be conducted periodically and does not require performing a cold shutdown of the furnace, which reduces the time needed to get the furnace back online following decoking and is an important productivity consideration. In steam-air decoking, low pressure steam (e.g., 135 psig) and air are introduced into the furnace. Oxygen from the air reacts with the carbon deposits on the interior surfaces of the furnace tubes to form carbon dioxide gas, which is exhausted from the furnace, typically, to atmosphere. The steam serves to control temperature within the furnace during the decoking procedure. Steam-air decoking offers advantages over other decoking procedures such as steam-water decoke in which coke deposits react with water to form carbon monoxide and hydrogen.

Dislodged coke flows out of the furnace with the steam/air exhaust; however, obstructions may occur if dislodged coke accumulates in a pipe or at an outlet. For example, during a decoking procedure, large pieces of coke may dislodge from valleys of internally-finned radiant tubes and accumulate in a downstream elbow joint of a primary transfer line exchange outlet. This could result in low flow of air and steam through the radiant tubes leading to the obstructed outlet. Low flow of steam during decoke can cause temperature build-up in the affected tubes, necessitating a cold furnace shutdown to clear the pluggage. A cold furnace shutdown significantly increases the time required to bring the furnace back to normal operation, reducing productivity. A new technique is needed to address the problem of accumulating coke in an outlet of an olefin cracking furnace during a decoking procedure.

SUMMARY

It is found that introducing medium pressure steam through a pass of radiant tubes affected by an obstructed outlet is particularly effective as an adjunct, or backup, step in a steam-air decoking procedure conducted on an olefin cracking furnace. The unique arrangement of radiant tubes and outlets in an olefin cracking furnace allows for safe flow of the medium pressure steam through an affected pass while maintaining sufficient hydraulic surge to effectively dislodge the accumulated coke without requiring a cold shutdown of the furnace and without disrupting the ongoing decoking of other passes of radiant tubes of the furnace.

Accordingly, the present disclosure describes a method for removing coke deposits in radiant tubes of an olefin cracking furnace and removing accumulated spalled coke from one or more outlet elbows of the olefin cracking furnace without performing a cold shutdown of the furnace. The method includes (a) introducing decoking air and low pressure steam into a plurality of radiant tubes of the olefin cracking furnace, and maintaining flow through the plurality of radiant tubes for a first period of time; (b) identifying a first outlet elbow with restricted flow therethrough due to accumulated spalled coke resulting from step (a); and (c) introducing medium pressure steam through a first subset of the plurality of radiant tubes, the first subset of tubes comprising (i) a plurality of tubes upstream of one or more outlet elbows through which flow is not restricted and (ii) a second subset of tubes upstream of the first outlet elbow identified in step (b) through which flow is restricted, and maintaining flow therethrough for a second period of time, thereby removing accumulated spalled coke from the first outlet elbow.

In some embodiments, medium pressure steam used in accordance with the present disclosure is from about 300 psig to about 600 psig. In certain embodiments, the medium pressure steam is about 400 psig.

In some embodiments, low pressure steam used in accordance with the present disclosure is from about 100 psig to about 200 psig.

In some embodiments, a first elbow is located at an outlet. Exemplary outlets include, but are not limited to, primary transfer line exchanger (PTLE) outlet, primary quench exchanger (PQE) outlet, and Transfer Line Exchanger (TLE) outlet.

In some embodiments, a second subset of tubes upstream of a first outlet elbow comprises at least two radiant tubes. In certain embodiments, a second subset of radiant tubes consists of two or four radiant tubes.

In some embodiments, the plurality of radiant tubes comprises a plurality of octants.

For example, an octant is one of a plurality of (e.g., eight, but not necessarily eight) radiant tube banks making up a flow pass. The octant includes sets of tubes whose outlets are connected, e.g., via tetra fittings, or "Y" fittings, for entry into primary transfer line exchangers (PTLE), primary quench exchangers (PQE), or transfer line exchangers (TLE). The first subset of the plurality of radiant tubes may be a first octant of radiant tubes including the second subset of radiant tubes (those upstream of the outlet elbow with restricted flow therethrough) and a plurality of other radiant tubes upstream of one or more outlet elbows through which flow is not restricted, wherein the octants other than the first octant do not comprise radiant tubes upstream of an outlet elbow with restricted flow therethrough, that is, the other octants are unaffected by the blockage.

In certain embodiments, the plurality of radiant tubes consists of at least eight octants. Each octant may consist of from 20 radiant tubes to 50 radiant tubes. More specifically, in certain embodiments, the first octant of tubes consists of 36 tubes including four tubes upstream of the first outlet elbow with restricted flow therethrough and 32 tubes upstream of 8 outlet elbows which do not have restricted flow threrethrough. In other embodiments, the first octant of tubes consists of 24 tubes including four tubes upstream of the first outlet elbow with restricted flow therethrough and 20 tubes upstream of 5 outlet elbows which do not have restricted flow therethrough.

In certain embodiments, the decoking air and low pressure steam continue to flow through octants other than the first octant while medium pressure steam is introduced through the first octant during step (c).

In certain embodiments, the method comprises shutting off flow of the decoking air to all octants of the furnace prior to step (c) and continuing to transmit the low pressure steam through octants other than the first octant while medium pressure steam is introduced through the first octant during step (c).

In certain embodiments, the furnace includes a check valve downstream of a control valve for the medium pressure steam. The check valve limits or eliminates the impact of the medium pressure steam on the octants other than the first octant, where the first octant includes the radiant tubes leading to the plugged PTLE outlet.

In some embodiments, the plurality of radiant tubes have internal fins, weld-bead type static mixing elements, and/or smooth bore. In some embodiments, the plurality of radiant tubes have round equivalent internal diameter from about 1 inch to about 3 inches. In certain embodiments, the plurality of radiant tubes have round equivalent internal diameter of about 1.55 inches.

In some embodiments, the first outlet elbow has entrance internal diameter and/or exit internal diameter of less than about 3 inches.

In some embodiments, step (a) may include introducing decoking air at a rate from about 1000 lb/hr to about 5000 lb/hr and low pressure steam at a rate from about 7000 lb/hr to about 10,000 lb/hr into the plurality of radiant tubes. In some embodiments, step (c) includes introducing medium pressure steam through the first subset of radiant tubes at a rate from about 5000 lb/hr to about 40,000 lb/hr. In some embodiments, step (c) includes introducing medium pressure steam through the first subset of radiant tubes at a rate from about 5000 lb/hr to about 25,000 lb/hr.

In some embodiments, at least one of the low pressure steam, the decoking air, and the medium pressure steam is at a temperature from about 400° F. to about 800° F.

In some embodiments, step (a) as described herein includes maintaining the flow of decoking air and low pressure steam through the plurality of radiant tubes for a period of time from about 16 hours to about 24 hours, In some embodiments, step (c) as described herein includes maintaining the flow of medium pressure steam through the first subset of tubes for a period of time from a few minutes to several hours, as necessary to clear the pluggage. In certain embodiments, the flow of medium pressure steam is maintained for a period from about 10 minutes to about 30 minutes.

In some embodiments, step (b) as described herein includes identifying the first outlet elbow with restricted flow therethrough by visual inspection of the radiant tubes upstream of the first outlet elbow. For example, a group of four adjacent radiant tubes leading to a blocked PTLE outlet may have exterior walls that become a different color than the other tubes and/or they may be non-uniform in color whereas the color of the other tubes are essentially uniform. In addition or alternatively, step (b) may include identifying the first outlet elbow with restricted flow therethrough by monitoring a temperature of one or more tubes upstream of the first outlet elbow.

In accordance with the present disclosure, the methods may include lining-up the supply of medium pressure steam for step (c) by opening a block valve then opening a control valve.

In some embodiments, step (c) as described herein includes opening a medium pressure steam control valve while simultaneously blocking-in the low pressure steam and air supply to the first subset of tubes. In further embodiments, step (c) also includes a step of closing the medium pressure steam control valve after it has been determined the accumulated spalled coke has been removed from the first outlet elbow. If the furnace logic does not allow for the low pressure steam flow and/or the medium pressure steam flow to be factored into the control logic, step (c) may cause furnace trip.

In accordance with the present disclosure, the methods may include blocking-in and depressurizing the medium pressure steam system following step (c).

Methods described herein may further include resetting fuel gas valves for resumption of olefin cracking operation of the furnace.

In some embodiments, an olefin cracking furnace used in accordance with the present disclosure has olefin production capacity of at least about 100,000 metric tons per annum (i.e., at least about 100 kTA). In some embodiments, the olefin cracking furnace has olefin production capacity of from about 100 kTA to about 300 kTA. In some embodiments, an olefin cracking furnace has olefin production capacity of at least about 220,000 metric tons per annum (i.e., at least about 220 kTA). In some embodiments, the coke deposits result from cracking an ethane or ethane-rich (e.g., more than 50 vol. %, more than 60 vol. %, more than 70 vol. %, or more than 80 vol. %) feed stream. In some embodiments, the coke deposits result from decoking other feedstocks useful in the production of olefins via pyrolysis.

Other features, objects, and advantages of the present invention are apparent in the detailed description, drawings and claims that follow. It should be understood, however, that the detailed description, the drawings, and the claims, while indicating embodiments of the present invention, are given by way of illustration only, not limitation. Various changes and modifications within the scope of the invention will become apparent to those skilled in the art.

DETAILED DESCRIPTION

It should be understood that the order of steps or order for performing certain actions is immaterial so long as the invention remains operable. Moreover, two or more steps or actions may be conducted simultaneously.

The mention herein of any publication or technique, for example, in the Background section, is not an admission that the publication or technique serves as prior art with respect to any of the claims presented herein. The Background section is presented for purposes of clarity and is not meant as a description of prior art with respect to any claim.

Coke typically contains about 80% to 95% carbon by weight with the balance comprising sulfur, nitrogen inorganic materials, ash, and small amounts of oxygen. Coke deposits which form in radiant tubes, heat exchangers, reactors, etc. degrade heat transfer and fuel flow characteristics and, if left unchecked, can lead to system failure.

It is found that introducing medium pressure (MP) steam through a pass of radiant tubes affected by an obstructed outlet (e.g., a PTLE outlet) is particularly effective as an adjunct, or backup, step in a steam-air decoking procedure conducted on an olefin cracking furnace. The unique arrangement of radiant tubes and outlets in an olefin cracking furnace allows for safe flow of the medium pressure steam through an affected pass while maintaining sufficient hydraulic surge to effectively dislodge the accumulated coke without requiring a cold shutdown of the furnace and without disrupting the ongoing decoking of other passes of radiant tubes of the furnace. Methods and systems described herein are helpful to overcome excessive down time caused by an obstructed PTLE outlet elbow.

Without wishing to be bound by any theory, it appears that the need for MP steam intervention during steam-air decoke (SAD) to dislodge accumulated coke from PTLE outlets is exacerbated by: a) an under-sized PTLE internal diameter; b) a PTLE outlet with short turn 90° radius; c) the use of 4×1 tetra fittings to one PTLE rather than 2×1 wyes to one PTLE; d) the use of ethane or ethane-rich cracking process feed streams, which are found to produce hard coke; and/or e) the use of radiant tubes that have internal fins or weld-bead type static mixing elements, such that long shards of coke form in the valleys or crevices of such fins or elements and break off during decoking, accumulating at a PTLE outlet.

Figure 1:
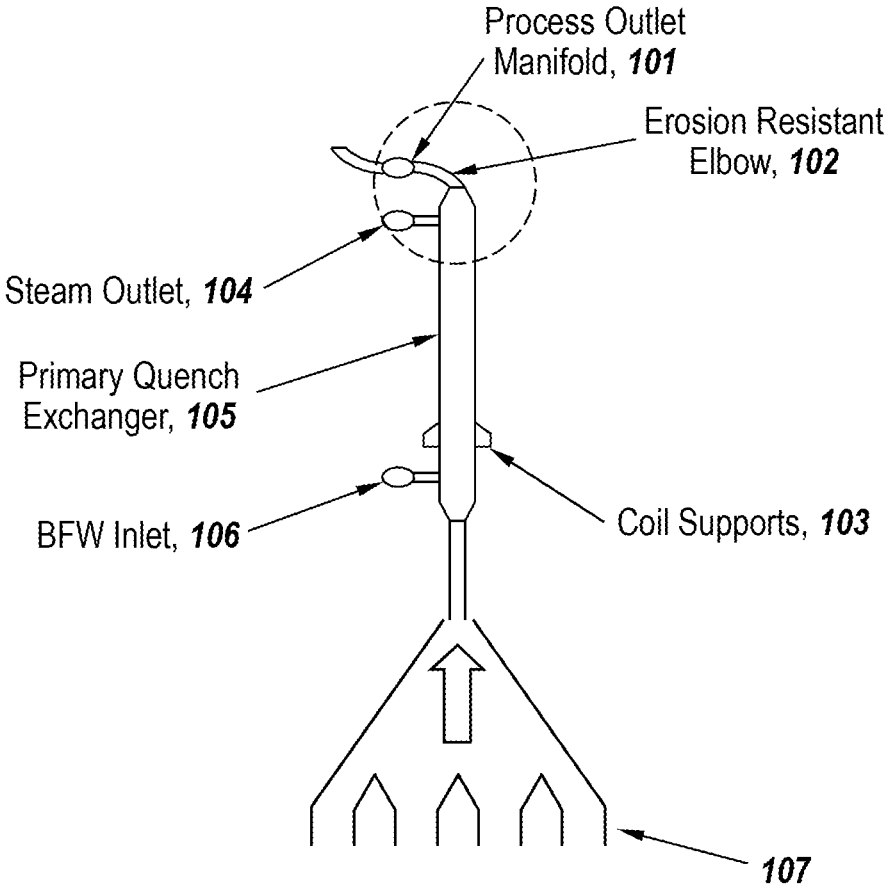
FIG. 1 illustrates a typical olefin cracking furnace having a primary transfer line exchanger (PTLE) outlet.

Referring to FIG. 1, a typical olefin cracking furnace has a primary quench exchanger (PTLE) outlet connected to four radiant tubes 107. The PTLE 105 has a Boiler Feed Water (BFW) inlet 106 and coil supports 103. The circled area is the PTLE outlet including a steam outlet 104, an erosion resistant elbow 102 and process outlet manifold 101.

Figure 2:
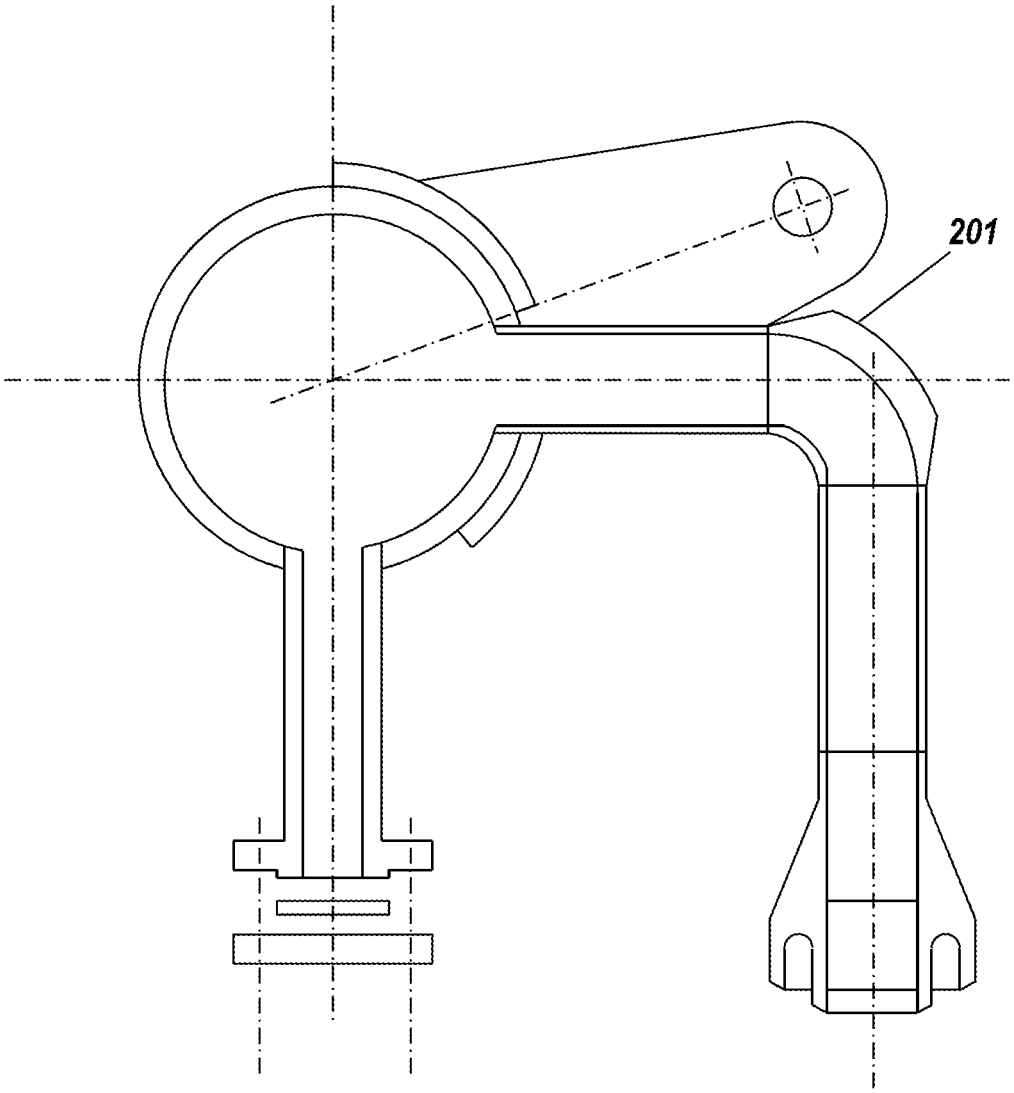
FIG. 2 is a schematic view of a tight 90° radius elbow of a PTLE outlet.

FIG. 2 depicts an exemplary PTLE outlet elbow 201 from FIG. 1 with a short turn tight radius of 90°. It is believed this structure may contribute to the coke accumulation problem that the MP steam intervention procedure addresses.

Figure 3:
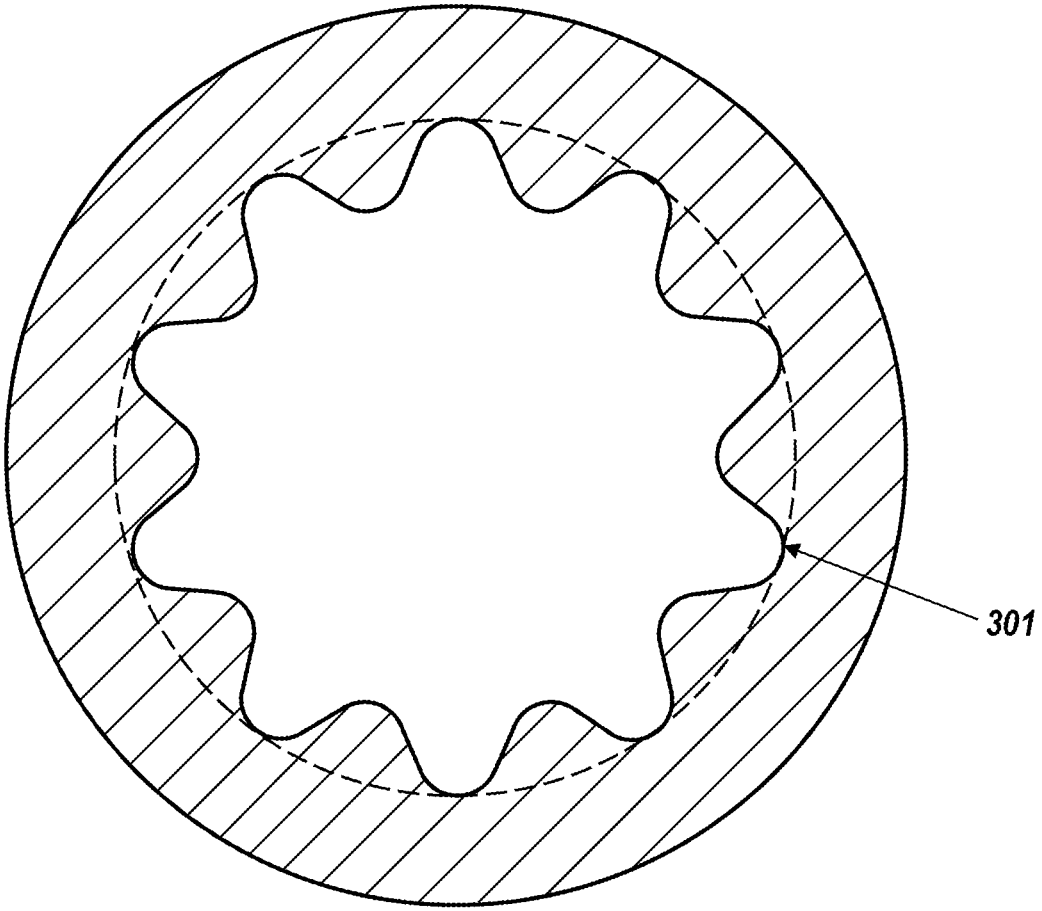
FIG. 3 shows a typical cross-section of an internally finned radiant tube where valley coke forms during normal operation of a cracking furnace.

Now turning to FIG. 3, a cross-section of a radiant tube is shown. For example, a round equivalent internal diameter of a radiant tube can be from about 1 to about 2 inches, e.g., 1.55 inches. As illustrated, there are 10 internal fins 301 which are provided to increase heat transfer area inside the tube. Long shards of coke form in the valleys of such fins during olefin cracking and break off during decoking, accumulating at a PTLE outlet elbow 102.

Hard catalytic coke builds in the valleys of internally finned tubes in cracking furnaces that employ ethane or ethane-rich feedstocks, forming long shards, e.g., 8-12 inches in length. Plugging can occur whenever the size or amount of coke that is spalled or otherwise released from the tube wall is too great to pass through the PTLE outlet elbow 102. It is not possible to combust the coke in this area of piping via Steam Air Decoke (SAD) or Steam Water Decoking (SWD) because the temperature is too low. Normal conditions of decoking steam (7-10 klb/hr, 105-175 psig) and air (1-5 klb/hr, 110-120 psig) lack sufficient pressure and/or flow to decoke valley coke from Primary Transfer Line Exchange (PTLE) outlet elbows. By comparison, it is found that the use of Medium Pressure (MP) steam during SAD supplies sufficient pressure and flow to crush, break, or otherwise physically move or dislodge valley coke from PTLE outlet elbows.

Figure 4:
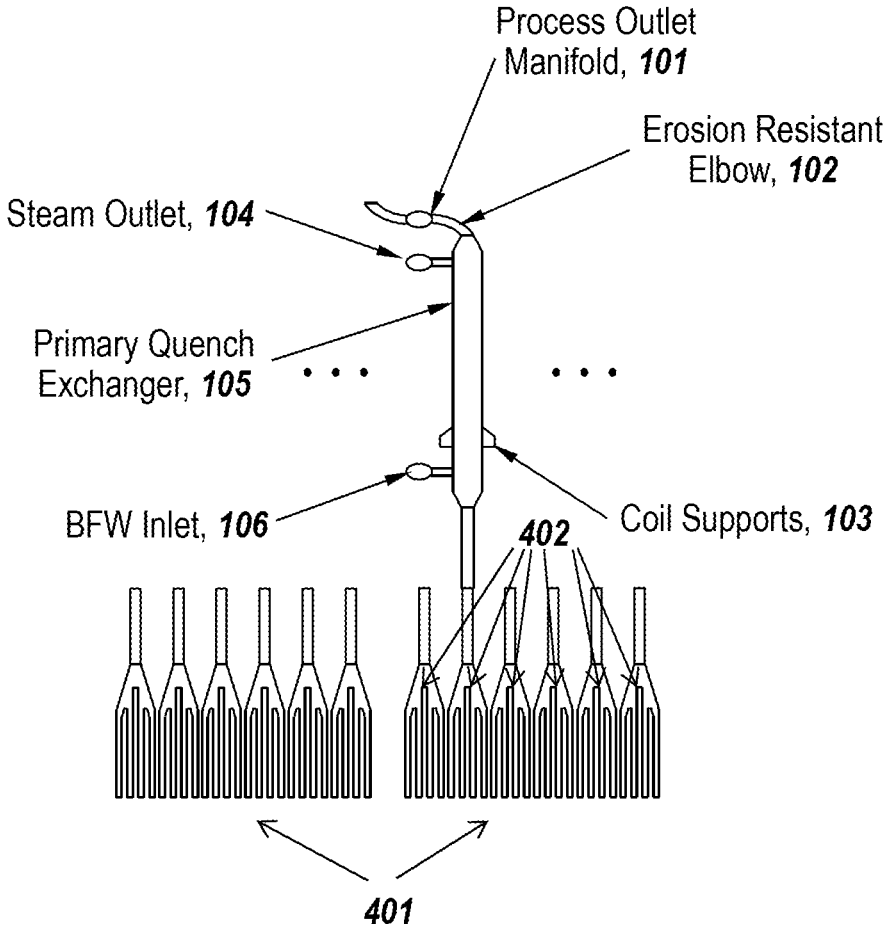
FIG. 4 shows four passes of a radiant tube assembly for an olefin cracking furnace that has a total of eight passes (octants), each pass having 36 tubes that end in nine harps, each harp having 4 tubes and a tetra fitting for single conduit to a primary transfer line exchanger.

FIG. 4 shows four passes 401 of a radiant tube assembly for an olefin cracking furnace that has a total of eight passes (octants), each pass having 24 radiant tubes that end in six harps 402, each harp having 4 tubes and a tetra fitting for single conduit to a primary transfer line exchanger (PTLE) 105. Only one PTLE is shown in FIG. 4, but it is understood that each 4-tube harp has an associated PTLE. An octant, as the term is used herein, is one of a plurality of (e.g., eight, but not necessarily eight) radiant tube banks making up a flow pass. The octant includes sets of tubes whose outlets are connected, e.g., via tetra fittings, for entry into primary transfer line exchangers (PTLE) or transfer line exchangers (TLE). The unique arrangement of radiant tubes and outlets in an olefin cracking furnace allows for the safe flow of the MP steam through an affected pass while maintaining sufficient hydraulic surge to effectively dislodge the accumulated coke without requiring a cold shutdown of the furnace and without disrupting the ongoing decoking of other passes of radiant tubes of the furnace. Because MP steam is transmitted through radiant tubes whose PTLE outlets are not obstructed as well as tubes whose PTLE outlet is obstructed, the danger posed by pressure build up or backflow of MP steam is minimized. Furthermore, it is found that the MP steam pressure is great enough such that the hydraulic surge is sufficient to remove the accumulated coke from the PTLE outlet in relatively short order (e.g., from 10 to 20 minutes).

The present disclosure provides a method for removing coke deposits in radiant tubes of an olefin cracking furnace and removing accumulated spalled coke from one or more outlet elbows of the furnace without performing a cold shutdown of the furnace, the method comprising the steps of: (a) introducing decking air and low pressure steam into a plurality of radiant tubes of the olefin cracking furnace, and maintaining flow through the plurality of radiant tubes for a first period of time; (b) identifying a first outlet elbow with restricted flow therethrough due to accumulated spalled coke resulting from step (a); and (c) introducing medium pressure steam through a first subset of the plurality of radiant tubes, the first subset of tubes comprising (i) a plurality of tubes upstream of one or more outlet elbows through which flow is not restricted and (ii) a second subset of tubes upstream of the first outlet elbow identified in step (b) through which flow is restricted, and maintaining flow therethrough for a second period of time, thereby removing accumulated spalled coke from the first outlet elbow.

In accordance with the present disclosure, MP steam piping and controls are provided. In some embodiments, relevant sections of feed, dilution steam, and decoking air piping are designed and rated for MP steam temperature, pressure and flow. Additionally, a check valve to automatically protect feed and decoke air piping can be used to eliminate the requirement of manually blocking the common air source and individual feed pass controllers to the affected octant. In some embodiments, Safety Instrumented System (SIS) for the furnace interlock system may be modified such that the furnace will not trip on low-flow with the use of MP steam intervention during steam-air decoke (SAD). Alternatively or additionally, manually blocking decoke air and/or normal decoking steam flow to the affected octant can be used with the methods and systems described herein. Some embodiments include resetting low fire trip and/or Fuel Gas (FG) valves.

In some embodiments, use of MP steam during SAD is helpful for quickly addressing aggressive exotherms of COTs above 1700° F. and/or cause/promote mechanical spalling before air addition to expedite decoking A person of ordinary skill in the art would be able to optimize controls and procedures accordingly. Large bore PTLEs may be used as well.

Exemplifications

In this example, while in SAD mode, when four consecutive radiant tubes associated with a single PLTE appear plugged, the following procedures are used. First, a MP steam system is warmed up and a MP steam is lined up to control value on affected octant. MP steam control valve is then opened slowly while simultaneously a normal decoke steam and air supply to the affected octant is blocked-in. This should be done if there is a danger the furnace may trip on low-flow to the affected octant, due to configuration of the Safety Interlock System (SIS).

During a 10-20 minute period, the MP steam is increased to a rate of up to about 40klb/hr, as needed. Plugged radiant tubes are monitored for visual signs of clearing. In some embodiments, the MP steam flow is adjusted from 5 to 40 k in steps to aid in hydraulically dislodging the bridged coke.

As the tubes clear, the MP steam control valve is closed and simultaneously the normal decoke steam and air flow is restarted only in the affected octant for 20-30 minutes to ensure the tubes are fully decoked. The MP steam system is then blocked-in and depressured.

A flow fire trip condition is cleared and, if necessary, FG valves are reset. The cleared tubes are monitored for signs of active burning and proceed accordingly. After the tubes are fully decoked and uniform in color to the surrounding tubes, normal SAD procedures resume for completion of SAD, and the furnace may be returned to normal cracking operations.

Other Embodiments and Equivalents

While the present disclosures have been described in conjunction with various embodiments and examples, it is not intended that they be limited to such embodiments or examples. On the contrary, the disclosures encompass various alternatives, modifications, and equivalents, as will be appreciated by those of skill in the art. Accordingly, the descriptions, methods and diagrams of should not be read as limited to the described order of elements unless stated to that effect.

Although this disclosure has described and illustrated certain embodiments, it is to be understood that the disclosure is not restricted to those particular embodiments. Rather, the disclosure includes all embodiments that are functional and/or equivalents of the specific embodiments and features that have been described and illustrated.

I claim:

1. A method for removing coke deposits in radiant tubes of an olefin cracking furnace and removing accumulated spalled coke from one or more outlet elbows of the olefin cracking furnace without performing a cold shutdown of the furnace, the method comprising the steps of:

(a) introducing decoking air and low pressure steam into a plurality of radiant tubes of the olefin cracking furnace, and maintaining flow through the plurality of radiant tubes for a first period of time;

(b) identifying a first outlet elbow with restricted flow therethrough due to accumulated spalled coke resulting from step (a); and (c) lining-up a supply of medium pressure steam by opening a block valve then opening a control valve, and introducing the medium pressure steam through a first subset of the plurality of radiant tubes, the first subset of tubes comprising (i) a plurality of tubes upstream of one or more outlet elbows through which flow is not restricted and (ii) a second subset of tubes upstream of the first outlet elbow identified in step (b) through which flow is restricted, and maintaining flow therethrough for a second period of time, thereby removing accumulated spalled coke from the first outlet elbow.

2. The method of claim 1, wherein the medium pressure steam is from about 300 psig to about 600 psig.

3. The method of claim 2, wherein the medium pressure steam is about 400 psig.

4. The method of claim 1, wherein the low pressure steam is from about 100 psig to about 200 psig.

5. The method of claim 1, wherein the first outlet elbow is located at a primary transfer line exchanger (PTLE) or Transfer Line Exchanger (TLE) outlet.

6. The method of claim 1, wherein the second subset of tubes upstream of the first outlet elbow comprises at least two radiant tubes.

7. The method of claim 1, wherein the second subset of tubes upstream of the first outlet elbow consists of two or four radiant tubes.

8. The method of claim 1, wherein the plurality of radiant tubes comprises a plurality of octants, wherein the first subset of the plurality of radiant tubes is a first octant of tubes comprising the second subset of tubes and a plurality of other radiant tubes upstream of one or more outlet elbows through which flow is not restricted, wherein the octants other than the first octant do not comprise tubes upstream of an outlet elbow with restricted flow therethrough.

9. The method of claim 8, wherein the plurality of radiant tubes consists of at least eight octants.

10. The method of claim 8, wherein each octant consists of from 20 tubes to 50 tubes.

11. The method of claim 10, wherein the first octant of tubes consists of 36 tubes including four tubes upstream of the first outlet elbow with restricted flow therethrough and 32 tubes upstream of 8 outlet elbows which do not have restricted flow therethrough.

12. The method of claim 8, wherein the decoking air and the low pressure steam continue to flow through octants other than the first octant while medium pressure steam is introduced through the first octant during step (c).

13. The method of claim 1, wherein the plurality of radiant tubes have internal fins.

14. The method of claim 1, wherein the plurality of radiant tubes have weld-bead type static mixing elements.

15. The method of claim 1, wherein the plurality of radiant tubes have a round equivalent internal diameter from about 1 inch to about 2 inches.

16. The method of claim 15, wherein the plurality of radiant tubes have a round equivalent internal diameter of about 1.55 inches.

17. The method of claim 1, wherein the first outlet elbow has an entrance internal diameter and/or exit internal diameter of less than about 3 inches.

18. The method of claim 1, wherein step (a) comprises introducing decoking air at a rate from about 1000 lb/hr to about 5000 lb/hr and low pressure steam at a rate from about 7000 lb/hr to about 10,000 lb/hr into the plurality of radiant tubes.

19. The method of claim 1, wherein step (c) comprises introducing medium pressure steam through the first subset of radiant tubes at a rate from about 5000 lb/hr to about 40,000 lb/hr.

20. The method of claim 1, wherein at least one of the low pressure steam, the decoking air, and the medium pressure steam is at a temperature from about 400° F. to about 800° F.

21. The method of claim 1, wherein step (a) comprises maintaining the flow of decoking air and low pressure steam through the plurality of radiant tubes for a period of time from about 16 hours to about 24 hours.

22. The method of claim 1, wherein step (c) comprises maintaining the flow of medium pressure steam through the first subset of tubes until the accumulated spalled coke is dislodged and removed.

23. The method of claim 1, wherein step (b) comprises identifying the first outlet elbow with restricted flow therethrough by visual inspection of the radiant tubes upstream of the first outlet elbow.

24. The method of claim 1, wherein step (b) comprises identifying the first outlet elbow with restricted flow therethrough by monitoring a temperature of one or more tubes upstream of the first outlet elbow.

25. A method for removing coke deposits in radiant tubes of an olefin cracking furnace and removing accumulated spalled coke from one or more outlet elbows of the olefin cracking furnace without performing a cold shutdown of the furnace, the method comprising the steps of:

(a) introducing decoking air and low pressure steam into a plurality of radiant tubes of the olefin cracking furnace, and maintaining flow through the plurality of radiant tubes for a first period of time;

(b) identifying a first outlet elbow with restricted flow therethrough due to accumulated spalled coke resulting from step (a); and (c) introducing medium pressure steam through a first subset of the plurality of radiant tubes, the first subset of tubes comprising (i) a plurality of tubes upstream of one or more outlet elbows through which flow is not restricted and (ii) a second subset of tubes upstream of the first outlet elbow identified in step (b) through which flow is restricted, and maintaining flow therethrough for a second period of time, thereby removing accumulated spalled coke from the first outlet elbow, wherein step (c) comprises opening a medium pressure steam control valve while simultaneously blocking-in the low pressure steam and air supply to the first subset of tubes, thereby avoiding furnace trip due to low flow to an affected plurality of radiant tubes.

26. The method of claim 25, comprising the step of closing the medium pressure steam control valve while simultaneously opening a low pressure steam valve to permit flow of low pressure steam to the first subset of tubes after it has been determined the accumulated spalled coke has been removed from the first outlet elbow.

27. The method of claim 25, wherein the plurality of radiant tubes comprises a plurality of octants, wherein the first subset of the plurality of radiant tubes is a first octant of tubes comprising the second subset of tubes and a plurality of other radiant tubes upstream of one or more outlet elbows through which flow is not restricted, wherein the octants other than the first octant do not comprise tubes upstream of an outlet elbow with restricted flow therethrough and wherein step (c) comprises providing a check valve downstream of the medium pressure steam control valve to limit the impact of the medium pressure steam on the octants other than the first octant.

28. The method of claim 1, comprising blocking-in and depressurizing the medium pressure steam system following step (c).

29. The method of claim 1, further comprising resetting fuel gas valves for resumption of olefin cracking operation of the furnace.

30. The method of claim 1, wherein the olefin cracking furnace has olefin production capacity of at least about 100,000 metric tons per annum (at least about 100 kTA).

31. The method of claim 30, wherein the olefin cracking furnace has olefin production capacity from about 100 kTA to about 300 kTA.

32. The method of claim 30, wherein the olefin cracking furnace has olefin production capacity of at least about 220,000 metric tons per annum (at least about 220kTA).

33. The method of claim 1, wherein the coke deposits result from cracking a feedstock used in the production of olefins via pyrolysis.

34. The method of claim 25, wherein the medium pressure steam is from about 300 psig to about 600 psig.

35. The method of claim 34, wherein the medium pressure steam is about 400 psig.

36. The method of claim 25, wherein the low pressure steam is from about 100 psig to about 200 psig.

37. The method of claim 25, wherein the first outlet elbow is located at a primary transfer line exchanger (PTLE) or Transfer Line Exchanger (TLE) outlet.

38. The method of claim 25, wherein the second subset of tubes upstream of the first outlet elbow comprises at least two radiant tubes.

39. The method of claim 25, wherein the second subset of tubes upstream of the first outlet elbow consists of two or four radiant tubes.

40. The method of claim 25, wherein the plurality of radiant tubes comprises a plurality of octants, wherein the first subset of the plurality of radiant tubes is a first octant of tubes comprising the second subset of tubes and a plurality of other radiant tubes upstream of one or more outlet elbows through which flow is not restricted, wherein the octants other than the first octant do not comprise tubes upstream of an outlet elbow with restricted flow therethrough.

41. The method of claim 40, wherein the plurality of radiant tubes consists of at least eight octants.

42. The method of claim 40, wherein each octant consists of from 20 tubes to 50 tubes.

43. The method of claim 42, wherein the first octant of tubes consists of 36 tubes including four tubes upstream of the first outlet elbow with restricted flow therethrough and 32 tubes upstream of 8 outlet elbows which do not have restricted flow therethrough.

44. The method of claim 40, wherein the decoking air and the low pressure steam continue to flow through octants other than the first octant while medium pressure steam is introduced through the first octant during step (c).

45. The method of claim 25, wherein the plurality of radiant tubes have internal fins.

46. The method of claim 25, wherein the plurality of radiant tubes have weld-bead type static mixing elements.

47. The method of claim 25, wherein the plurality of radiant tubes have a round equivalent internal diameter from about 1 inch to about 2 inches.

48. The method of claim 47, wherein the plurality of radiant tubes have a round equivalent internal diameter of about 1.55 inches.

49. The method of claim 25, wherein the first outlet elbow has an entrance internal diameter and/or exit internal diameter of less than about 3 inches.

50. The method of claim 25, wherein step (a) comprises introducing decoking air at a rate from about 1000 lb/hr to about 5000 lb/hr and low pressure steam at a rate from about 7000 lb/hr to about 10,000 lb/hr into the plurality of radiant tubes.

51. The method of claim 25, wherein step (c) comprises introducing medium pressure steam through the first subset of radiant tubes at a rate from about 5000 lb/hr to about 40,000 lb/hr.

52. The method of claim 25, wherein at least one of the low pressure steam, the decoking air, and the medium pressure steam is at a temperature from about 400° F. to about 800° F.

53. The method of claim 25, wherein step (a) comprises maintaining the flow of decoking air and low pressure steam through the plurality of radiant tubes for a period of time from about 16 hours to about 24 hours.

54. The method of claim 25, wherein step (c) comprises maintaining the flow of medium pressure steam through the first subset of tubes until the accumulated spalled coke is dislodged and removed.

55. The method of claim 25, wherein step (b) comprises identifying the first outlet elbow with restricted flow therethrough by visual inspection of the radiant tubes upstream of the first outlet elbow.

56. The method of claim 25, wherein step (b) comprises identifying the first outlet elbow with restricted flow therethrough by monitoring a temperature of one or more tubes upstream of the first outlet elbow.

57. The method of claim 25, comprising blocking-in and depressurizing the medium pressure steam system following step (c).

58. The method of claim 25, further comprising resetting fuel gas valves for resumption of olefin cracking operation of the furnace.

59. The method of claim 25, wherein the olefin cracking furnace has olefin production capacity of at least about 100,000 metric tons per annum (at least about 100 kTA).

60. The method of claim 59, wherein the olefin cracking furnace has olefin production capacity from about 100 kTA to about 300 kTA.

61. The method of claim 59, wherein the olefin cracking furnace has olefin production capacity of at least about 220,000 metric tons per annum (at least about 220kTA).

62. The method of claim 25, wherein the coke deposits result from cracking a feedstock used in the production of olefins via pyrolysis.

* * * * *